US010670332B2

(12) United States Patent
Park

(10) Patent No.: US 10,670,332 B2
(45) Date of Patent: Jun. 2, 2020

(54) REFRIGERATOR

(71) Applicant: Samsung Electronics Co., Ltd, Gyeonggi-do (KR)

(72) Inventor: Kyoung Ki Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 117 days.

(21) Appl. No.: 15/856,756

(22) Filed: Dec. 28, 2017

(65) Prior Publication Data

US 2018/0187970 A1 Jul. 5, 2018

(30) Foreign Application Priority Data

Jan. 3, 2017 (KR) ..... 10-2017-0000616

(51) Int. Cl.
*F25D 31/00* (2006.01)
*F25D 21/14* (2006.01)
(Continued)

(52) U.S. Cl.
CPC ..... *F25D 31/002* (2013.01); *B67D 1/0858* (2013.01); *B67D 1/0891* (2013.01); *B67D 1/16* (2013.01); *F25C 5/22* (2018.01); *F25D 21/14* (2013.01); *F25D 23/04* (2013.01); *F25D 23/126* (2013.01); *B67D 2001/0087* (2013.01); *B67D 2001/0089* (2013.01); *F25D 21/04* (2013.01); *F25D 2321/142* (2013.01)

(58) Field of Classification Search
CPC ..... F25D 31/002; F25D 23/04; B67D 1/16; B67D 1/0858; B67D 1/0891; F25C 5/22
USPC ..... 62/389
See application file for complete search history.

(56) References Cited

U.S. PATENT DOCUMENTS 3,934,757 A 1/1976 Malek et al.
7,958,742 B2 6/2011 Park et al.
(Continued)

FOREIGN PATENT DOCUMENTS

CN 100585305 C 1/2010
CN 202092408 U 12/2011
(Continued)

OTHER PUBLICATIONS

European Patent Office Communication pursuant to Article 94(3) EPC regarding Application No. 18150211.3, dated May 7, 2019, 8 pages.
(Continued)

*Primary Examiner* — Steve S Tanenbaum

(57) ABSTRACT

A dispenser of a refrigerator includes a switch and a lever unit configured to pressurize the switch, and the lever unit includes a lever including a body and a pressurizer extending toward a rear side of the body and configured to pressurize the switch; a frame disposed behind the body and configured to support the lever; and a guide configured to cover the switch to prevent condensation from flowing into the switch and guide the condensation between the lever and the frame. Therefore, condensation can be effectively prevented from flowing into the switch, and the frame is inserted into an insertion portion provided at a door, four surfaces constituting the frame are brought into contact with and supported by the insertion portion, and thus the lever can be stably supported.

20 Claims, 14 Drawing Sheets

(51) Int. Cl.

| | |
|---|---|
| ***F25D 23/12*** | (2006.01) |
| ***B67D 1/08*** | (2006.01) |
| ***B67D 1/16*** | (2006.01) |
| ***F25D 23/04*** | (2006.01) |
| ***F25C 5/20*** | (2018.01) |
| *F25D 21/04* | (2006.01) |
| *B67D 1/00* | (2006.01) |

(56) References Cited

U.S. PATENT DOCUMENTS

| | | | | |
|---|---|---|---|---|
| 9,182,167 | B2 | 11/2015 | Park | |
| 2011/0259719 | A1* | 10/2011 | Park | F25D 23/126 200/310 |
| 2014/0042186 | A1 | 2/2014 | Clancy et al. | |
| 2017/0174493 | A1 | 6/2017 | Aranda et al. | |

FOREIGN PATENT DOCUMENTS

| | | | |
|---|---|---|---|
| EP | 1925895 | A2 | 5/2008 |
| EP | 2383531 | A2 | 11/2011 |
| KR | 10-2009-0036721 | A | 4/2009 |
| KR | 10-2012-0004014 | A | 1/2012 |
| KR | 101174993 | B1 * | 8/2012 |
| KR | 101174993 | B1 | 8/2012 |
| KR | 101397967 | B1 | 5/2014 |
| KR | 101650305 | B1 | 8/2016 |

OTHER PUBLICATIONS

European Patent Office, "European Search Report," Application No. EP 18150211.3, dated Jun. 5, 2018, 8 pages.

Office Action dated Oct. 31, 2019 in connection with Chinese Patent Application No. 201810004465.2, 17 pages.

* cited by examiner

REFRIGERATOR

CROSS-REFERENCE TO RELATED APPLICATION(S)

This application is related to and claims priority to Korean Patent Application No. 10-2017-0000616 filed on Jan. 3, 2017, the disclosure of which is incorporated herein by reference.

TECHNICAL FIELD

Embodiments of the present disclosure relate to a refrigerator, and more particularly, to a refrigerator including a dispenser with an improved structure.

BACKGROUND

Generally, a refrigerator is a home appliance that keeps various foods fresh and stores the foods for a long time by supplying cold air generated by an evaporator to a freezing compartment and a refrigerating compartment.

Foods to be kept below a freezing temperature, for example, meat, fish, ices, and the like, are stored in a freezing compartment, and foods to be kept above the freezing temperature, for example, vegetables, fruits, and drinks, are stored in a refrigerating compartment.

The refrigerator may also have an ice-making device configured to make and store ice, and, for user convenience, the refrigerator may supply the ice made by the ice-making device and water stored in a tank through a dispenser provided at a door of the refrigerator.

SUMMARY

To address the above-discussed deficiencies, it is a primary object to provide a refrigerator including a dispenser with an improved coupling structure.

Additional aspects of the disclosure will be set forth in part in the description which follows and, in part, will be obvious from the description, or may be learned by practice of the disclosure.

In accordance with one aspect of the present disclosure, a refrigerator includes a main body having a storage compartment; a door configured to open and close the storage compartment; and a dispenser including a switch and a lever unit configured to pressurize the switch, wherein the lever unit includes a lever including a body and a pressurizer extending toward a rear side of the body and configured to pressurize the switch; a frame disposed behind the body and configured to support the lever; and a guide configured to cover the switch to prevent condensation from flowing into the switch and guide the condensation between the lever and the frame.

The frame may include an open portion that is open in front and rear directions of the lever, the guide may extend from a rear surface of the body, and at least a portion of the guide may be provided to pass through the open portion.

The guide may include a bent portion disposed at a rear side of the open portion in a front direction and a rear direction of the lever and bent perpendicular to an extending direction of the guide.

The guide may include a guide surface provided between the rear surface of the body and the bent portion, and the guide surface may guide condensation, which flows from an outlet, in a vertical direction of the lever.

The guide surface may include a first surface extending in left and right directions of the lever, a pair of second surfaces extending from the first surface in the vertical direction of the lever, and a connecting surface configured to connect both ends of the first surface to upper ends of the pair of second surfaces, respectively.

The first surface may be disposed at an upper side of the switch, and the pair of second surfaces may be disposed at both sides of the switch, respectively.

The dispenser may further include an auxiliary guide disposed between the first surface and the switch to further prevent the condensation from flowing into the switch.

The auxiliary guide may cover the upper side of the switch and both of the sides thereof.

The lever may further include a tilt coupler extending toward a rear side of the lever and coupled to one side of the frame to tiltably couple the lever to the frame, and the frame may further include a tilt coupling recess disposed at the one side of the frame and provided to allow the tilt coupler to be rotatably inserted into the tilt coupling recess.

The lever unit may further include an elastic member disposed between the tilt coupler and the tilt coupling recess and configured to elastically support the lever, and the lever may further include a stopper configured to be brought into contact with the other side of the frame to restrict an elastic movement of the lever.

The frame may further include a guide protrusion extending from a rear surface of the frame toward the rear side to guide movement of the lever when the lever is tilted, and the lever may further include a cover provided at one side of the bent portion to cover the guide protrusion and allow the lever to be guided by the guide protrusion when the lever is tilted.

The frame may include an upper surface, a bottom surface, and a pair of side surfaces provided between both ends of the upper surface and the bottom surface.

The dispenser may further include an insertion portion disposed at one side of the door to allow the lever unit to be inserted into the one side of the door, and the insertion portion may be provided to be brought into contact with the upper surface, the bottom surface, and the pair of side surfaces of the frame.

The frame may further include a hook portion extending toward a rear side of the frame and hook-coupled to the insertion portion, and the insertion portion may include a hook groove hook-coupled to the hook portion.

The frame may further include a contact protrusion extending from at least one among the upper surface, the bottom surface, and the pair of side surfaces of the frame and disposed to be brought into contact with the insertion portion.

In accordance with another aspect of the present disclosure, a refrigerator includes a main body having a storage compartment; a door configured to open and close the storage compartment; a switch disposed at one side of the door; a lever unit configured to pressurize the switch; an insertion portion at which the switch is disposed, into which the lever unit is inserted, and provided at the one side of the door, wherein the lever unit includes a lever including a body and a tilt coupler disposed at a rear side of the body and provided to allow the body to be tiltable; a frame coupled to the tilt coupler and inserted into the insertion portion; and a guide configured to cover an upper side and a side surface of the switch and guide condensation between the lever and the frame to prevent the condensation from flowing into the switch.

The frame may include an open portion which is open in front and rear directions of the lever, and the guide may extend from a rear surface of the body and is provided at a position corresponding to the open portion in a vertical direction of the lever.

The insertion portion may include an auxiliary guide disposed between the guide and the switch to further prevent the condensation from flowing into the switch.

The auxiliary guide may be provided to cover the upper side and the side surface of the switch.

In accordance with still another aspect of the present disclosure, a refrigerator includes a main body having a storage compartment; a door configured to open and close the storage compartment; a switch disposed at one side of the door; a lever unit configured to pressurize the switch; and an insertion portion in which the switch is disposed, into which the lever unit is inserted, and having four surfaces formed to be recessed from the one side of the door toward an interior of the door, wherein the lever unit includes a frame having four surfaces configured to be brought into contact with the four surfaces of the insertion portion, respectively, and inserted into the insertion portion; a lever coupled to the frame; and a guide configured to cover the switch to prevent condensation from flowing into the switch.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
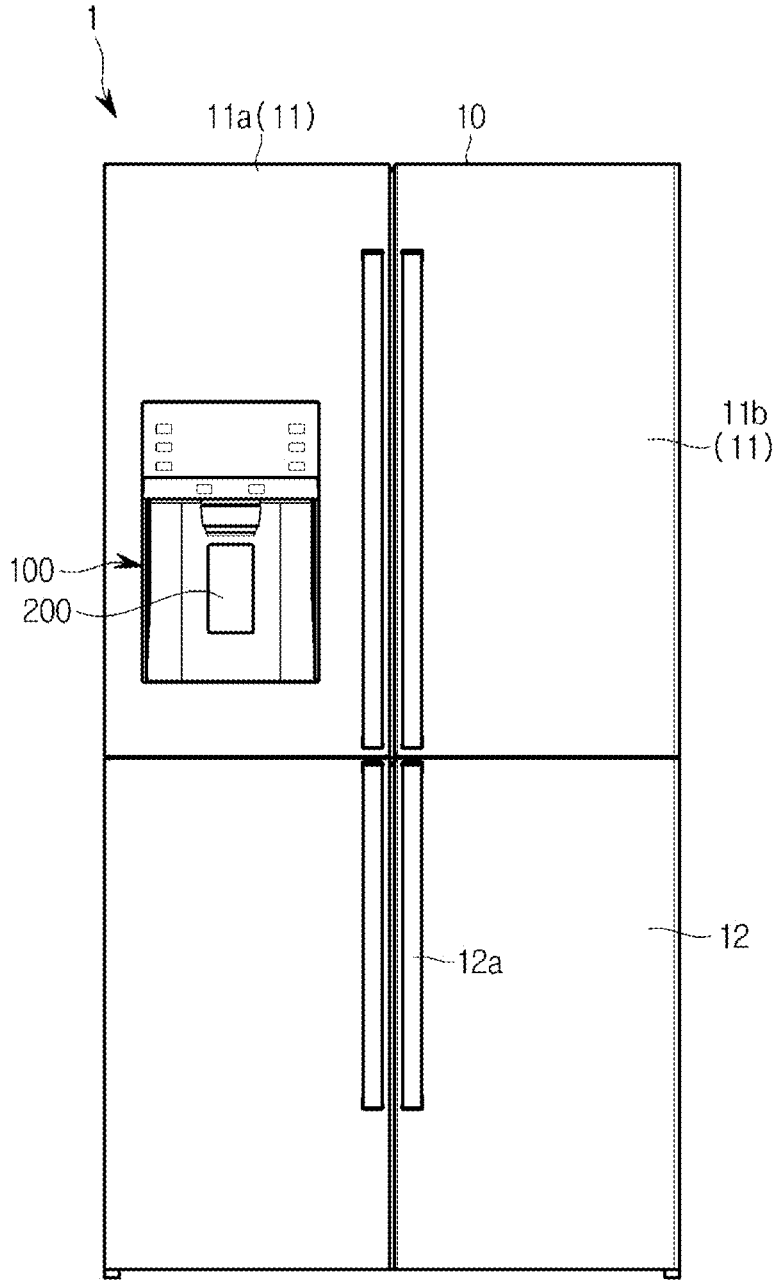
FIG. 1 is a front view illustrating a refrigerator according to one embodiment of the present disclosure.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described herein and configurations shown in the accompanying drawings are merely preferred examples of the present disclosure, and various modified examples which may replace the embodiments and the accompanying drawings of the present disclosure may be made at the time at which the present application is filed.

Further, like reference numerals or symbols given in the various drawings of the present specification indicate parts or components that perform substantially the same functions.

Also, the terms used herein are used to describe the embodiments, and are not intended to restrict and/or limit the present disclosure. Unless the context clearly dictates otherwise, the singular form includes the plural form. In this description, the terms "comprising," "having," or the like are used to specify that a feature, a number, a step, an operation, a component, an element, or a combination thereof described herein exists, and do not preclude the presence or addition of one or more other features, numbers, steps, operations, components, elements, or combinations thereof.

Further, it should be understood that terms including ordinals such as "first," "second," and the like may be used herein to describe various components, but the components are not limited to the terms, and these terms are used only for the purpose of distinguishing one component from another. For example, without departing from the scope of the present disclosure, a first component may be referred to as a second component, and similarly, a second component may also be referred to as a first component. The term "and/or" includes a combination of a plurality of related listed items and any one item of the plurality of related listed items.

Hereinafter, embodiments of the present disclosure will be described in detail with reference to the accompanying drawings.

In the following description, a front surface and a front side are used to refer to a direction toward a front surface and a front side seen from the front of the refrigerator 1, as shown in FIG. 1, and a rear side is used to refer to a direction toward a rear side of the refrigerator 1.

Figure 2:
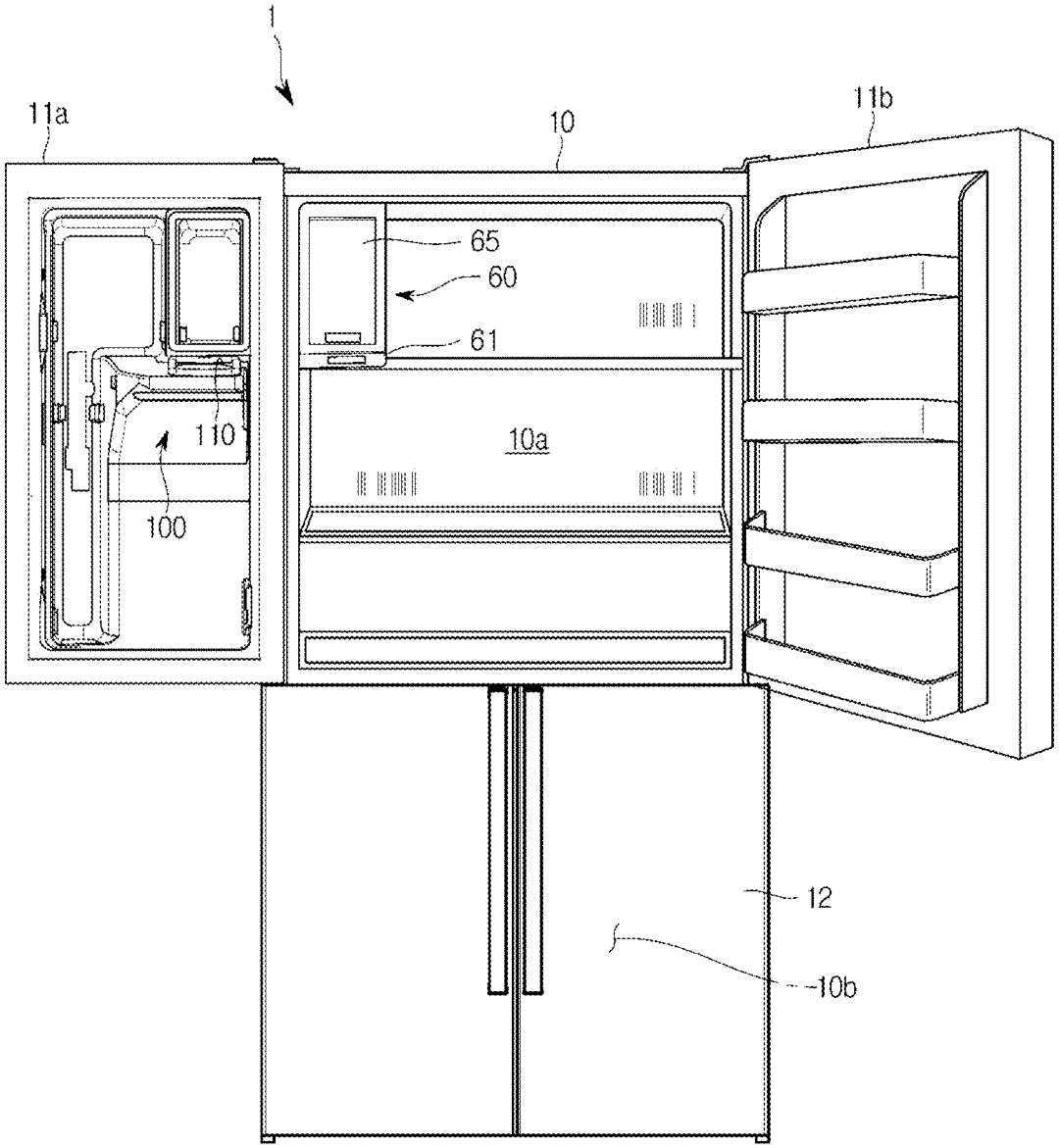
FIG. 2 is a front view illustrating a refrigerating compartment of the refrigerator according to one embodiment of the present disclosure.
Figure 3:
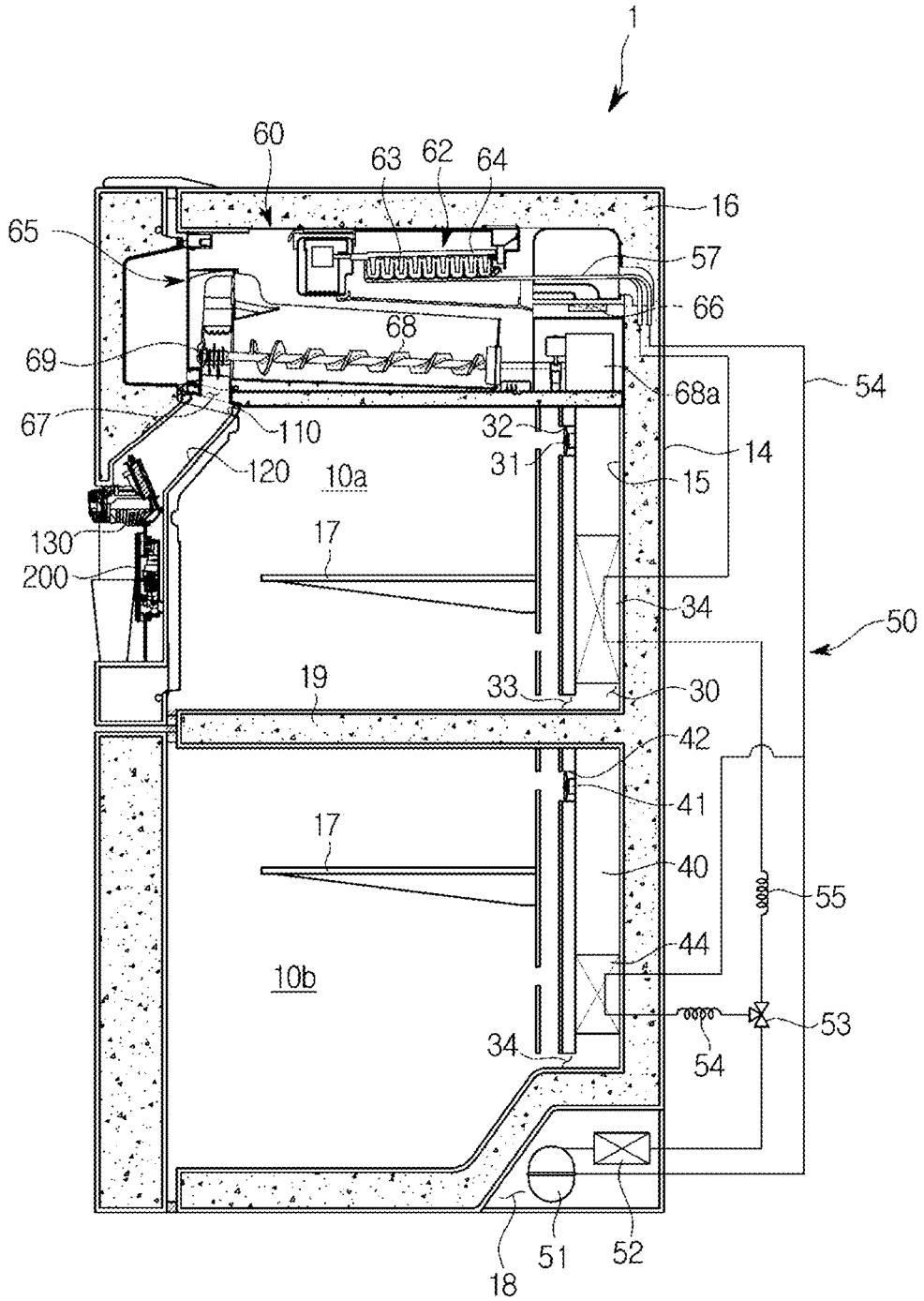
FIG. 3 is a side cross-sectional view of the refrigerator according to one embodiment of the present disclosure.

FIG. 1 is a front view illustrating a refrigerator according to one embodiment of the present disclosure, FIG. 2 is a front view illustrating a refrigerating compartment of the refrigerator according to one embodiment of the present disclosure, and FIG. 3 is a side cross-sectional view of the refrigerator according to one embodiment of the present disclosure.

As shown in FIGS. 1 to 3, the refrigerator 1 may include a main body 10 configured to form storage compartments 10*a* and 10*b* capable of keeping foods refrigerated or frozen, an ice making compartment 60 capable of making ice, and a cooling device 50 configured to supply cold air to the storage compartments 10*a* and 10*b* and the ice making compartment 60.

The main body 10 may be include an inner case 15 configured to form the storage compartments 10*a* and 10*b*, an outer case 14 coupled to an outer side the inner case 15 to form an exterior appearance of the main body 10, and an insulation 16 foamed in a space between the inner case 15 and the outer case 14.

A front surface of each of the storage compartments 10*a* and 10*b* may be formed to be open, and the storage compartments 10*a* and 10*b* may be partitioned by a partition wall 19 into an upper-side refrigerating compartment 10*a* and a lower-side freezing compartment 10*b*. The partition wall 19 may include the insulation 16 configured to block heat exchange between the refrigerating compartment 10*a* and the freezing compartment 10*b*.

A shelf 17 may be disposed in the refrigerating compartment 10*a* so that foods may be placed thereon, and a storage space of the refrigerating compartment 10*a* may be vertically comparted by the shelf 17. The open front surface of the refrigerating compartment 10*a* may be opened and closed by a pair of refrigerating compartment doors 11 which are rotatably hinge-coupled to the main body 10.

A dispenser 100 may be provided at the refrigerating compartment door 11 to allow ice of the ice making compartment 60 to be withdrawn from the outside without the refrigerating compartment door 11 being opened. The dispenser 100 may be configured to include an ice inlet 110 through which ice is introduced, a lever unit 200 configured to select whether to withdraw the ice, and a chute 120 configured to guide a discharge of the ice which is introduced into the dispenser 100 through the ice inlet 110. The dispenser 100 will be described in detail below.

The open front surface of the freezing compartment 10*b* may be opened and closed by a pair of freezing compartment doors 12 which are rotatably hinge-coupled to the main body 10. A handle 12*a* may be provided at each of the freezing compartment doors 12 so that a user can open and close the freezing compartment door 12.

The pair of refrigerating compartment doors 11 may include a first door 11*a* disposed on the left and a second door 11*b* disposed on the right. The first door 11*a* and the second door 11*b* are provided to be rotated and opened in opposite directions. In the embodiment of the present disclosure, the dispenser 100 and a cold air inflow compartment are provided at the first door 11*a*, and hereinafter, the refrigerator compartment door denotes the first door 11*a*.

Meanwhile, the cooling device 50 may be include a compressor 51 configured to compress a refrigerant to a high pressure, a condenser 52 configured to condense the compressed refrigerant, expansion devices 54 and 55 configured to expand the condensed refrigerant to a low pressure, evaporators 34 and 44 configured to evaporate the expanded refrigerant, and a refrigerant pipe 56 configured to guide the refrigerant.

The compressor 51 and the condenser 52 may be disposed in a machine compartment 18 provided at a lower portion of the rear side of the main body 10. Further, the evaporators 34 and 44 may be disposed in a cold air supply duct 30 provided in the refrigerating compartment 10*a* and a cold air supply duct 40 provided in the freezing compartment 10*b*, respectively.

The cold air supply duct 30 may include an intake hole 33, a cold air discharge hole 32, and a blowing fan 31, and may circulate cold air inside the refrigerating compartment 10*a*. Further, the cold air supply duct 40 may include an intake hole 43, a cold air discharge hole 42, and a blowing fan 41, and may circulate cold air inside the freezing compartment 10*b*.

The refrigerant pipe 56 may branch off at one position to allow the refrigerant to flow to the freezing compartment 10*b* or to flow to the refrigerating compartment 10*a* and the ice making compartment 60, and a switching valve 53 may be installed at the one position to switch a flow path of the refrigerant.

A portion 57 of the refrigerant pipe 56 may be disposed inside the ice making compartment 60 to cool the ice making compartment 60. The portion 57 of the refrigerant pipe 56 disposed inside the ice making compartment 60 may be in contact with an ice-making tray 63 to directly supply cooling energy to the ice-making tray 63 in a thermal conduction manner.

The ice making compartment 60 of the refrigerator 1 may be provided in the storage compartments 10*a* and 10*b* inside the main body 10. The ice making compartment 60 may be provided to be comparted from the storage compartments 10*a* and 10*b*. The ice making compartment 60 may be provided at an upper portion of one side of the refrigerating compartment 10*a*, and may be provided to be comparted from the refrigerating compartment 10*a* by an ice-making housing 61.

The ice-making housing 61 may be provided with an ice maker 62 configured to make ice and an ice bucket 65 configured to store the ice made by the ice maker 62.

The ice maker 62 includes the ice-making tray 63 configured to store water for making ice, an ejector 64 configured to separate ice from the ice-making tray 63, an ice separation motor (not shown) configured to rotate the ejector 64, an ice separation heater (not shown) configured to heat the ice-making tray 63 to facilitate separation of ice when the ice is separated from the ice-making tray 63, the ice bucket 65 configured to store ice made in the ice-making tray 63, and a fan 66 configured to circulate air inside the ice making compartment 60.

The ice bucket 65 is disposed below the ice-making tray 63 to collect ice dropping therefrom. The ice bucket 65 may be provided with an auger 68 configured to convey ice stored therein to an ice outlet 67, an auger motor 68*a* configured to drive the auger 68, and a crushing device 69 configured to crush the ice.

The ice conveyed to the ice outlet 67 via the auger 68 passes through the ice inlet 110 and the chute 120 of the dispenser 100 to be withdrawn through an outlet 130 so that a user can easily withdraw the ice without opening the door 11.

Although not shown in the drawing, a water tank (not shown) configured to store water may be provided inside the refrigerator 1, and water stored in the water tank (not shown) may be withdrawn through the outlet 130 of the dispenser 100.

The dispenser 100 may selectively withdraw water or ice in response to an operation of the user, and may be operated as the user pressurizes a lever unit 200. The dispenser 100 will be described in detail below.

Figure 4:
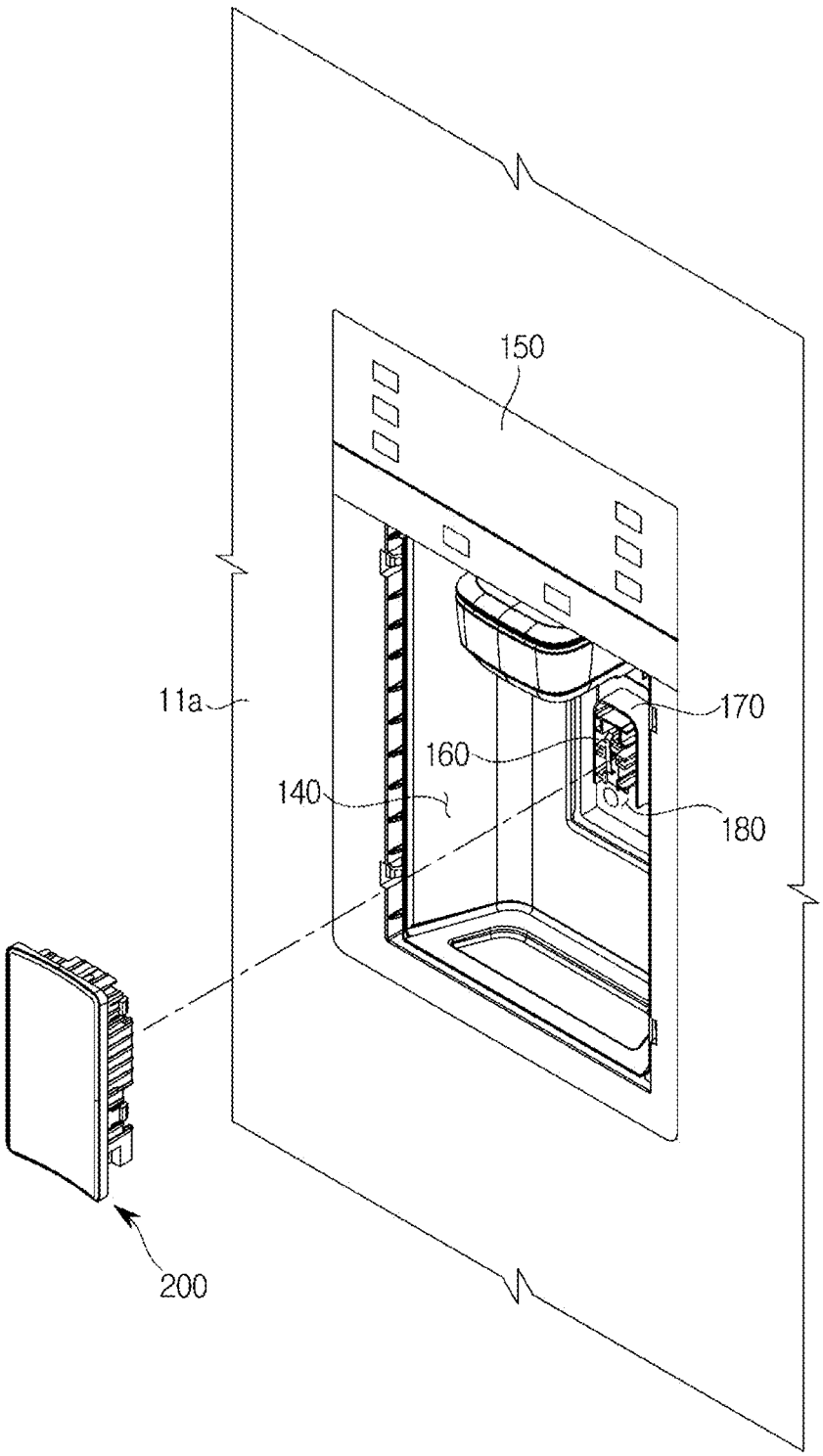
FIG. 4 is an exploded perspective view illustrating a portion of a configuration of a dispenser of the refrigerator according to one embodiment of the present disclosure.
Figure 5:
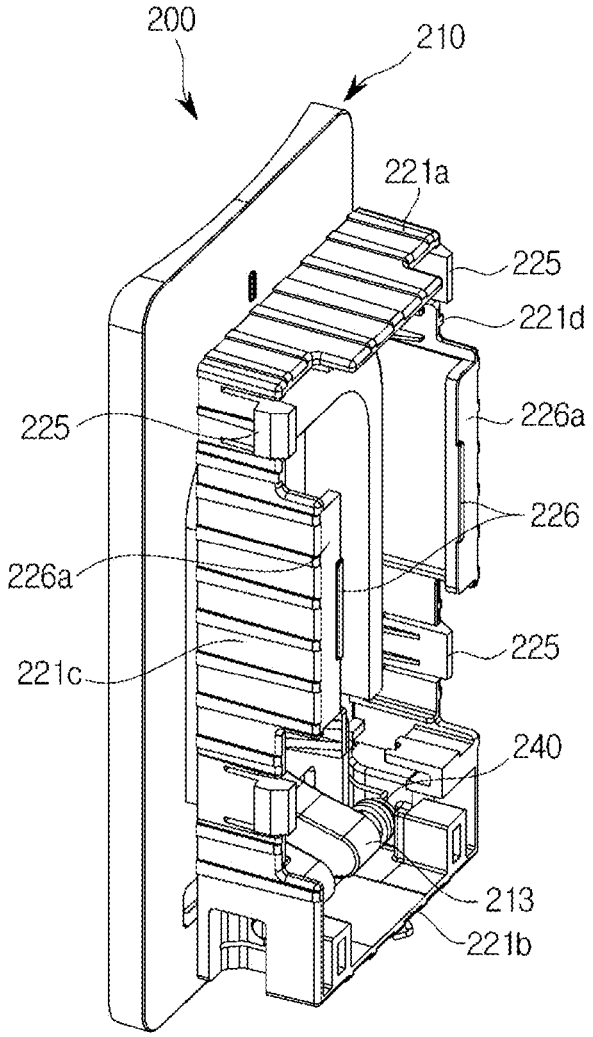
FIG. 5 is a perspective view illustrating a rear side of a lever unit of the refrigerator according to one embodiment of the present disclosure.
Figure 6:
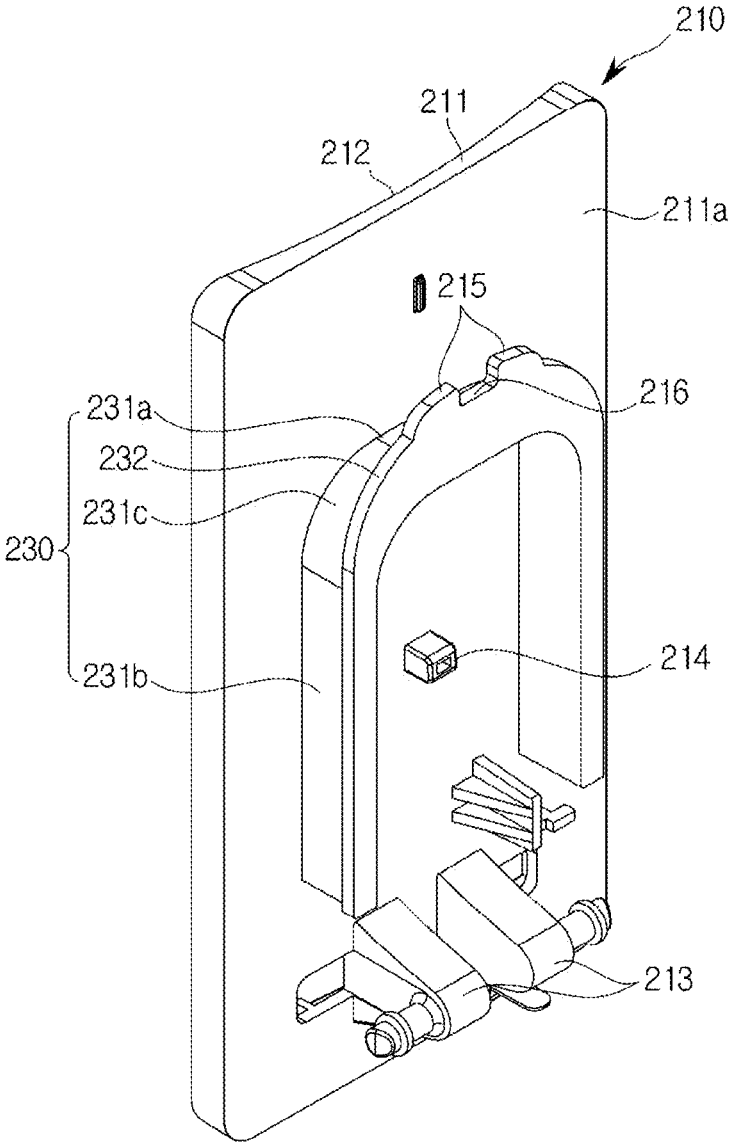
FIG. 6 is a perspective view illustrating rear sides of a lever and a guide of the refrigerator according to one embodiment of the present disclosure.
Figure 7:
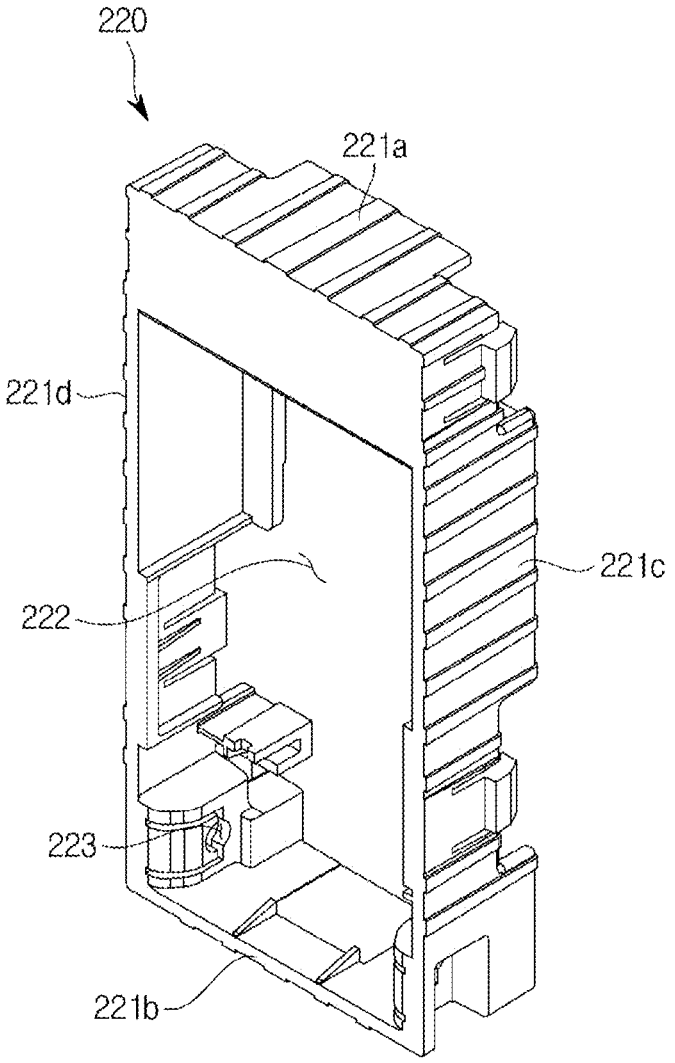
FIG. 7 is a perspective view of a frame of the refrigerator according to one embodiment of the present disclosure.
Figure 8:
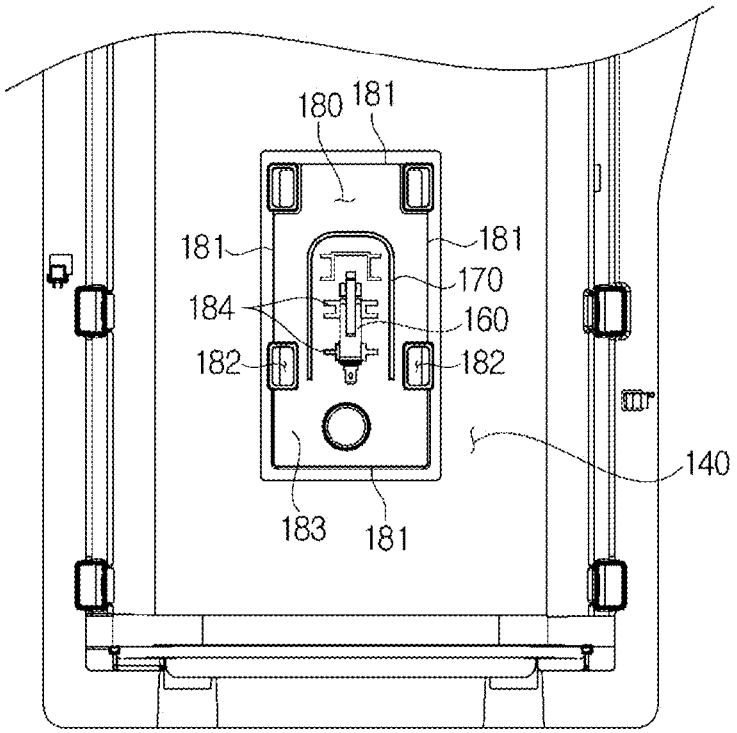
FIG. 8 is a front view of an insertion portion of the refrigerator according to one embodiment of the present disclosure.
Figure 9:
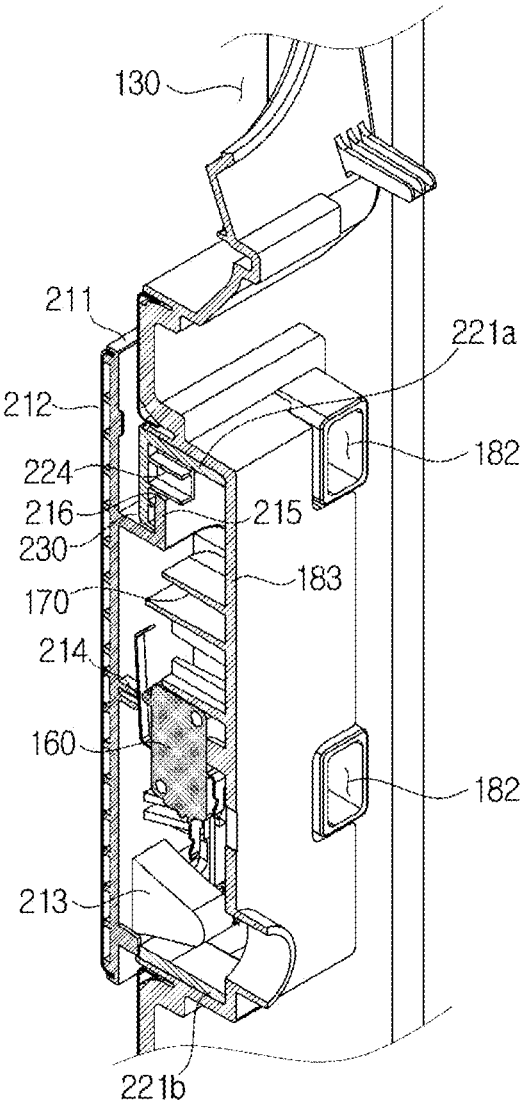
FIG. 9 is a cross-sectional perspective view of the dispenser of the refrigerator according to one embodiment of the present disclosure.
Figure 10:
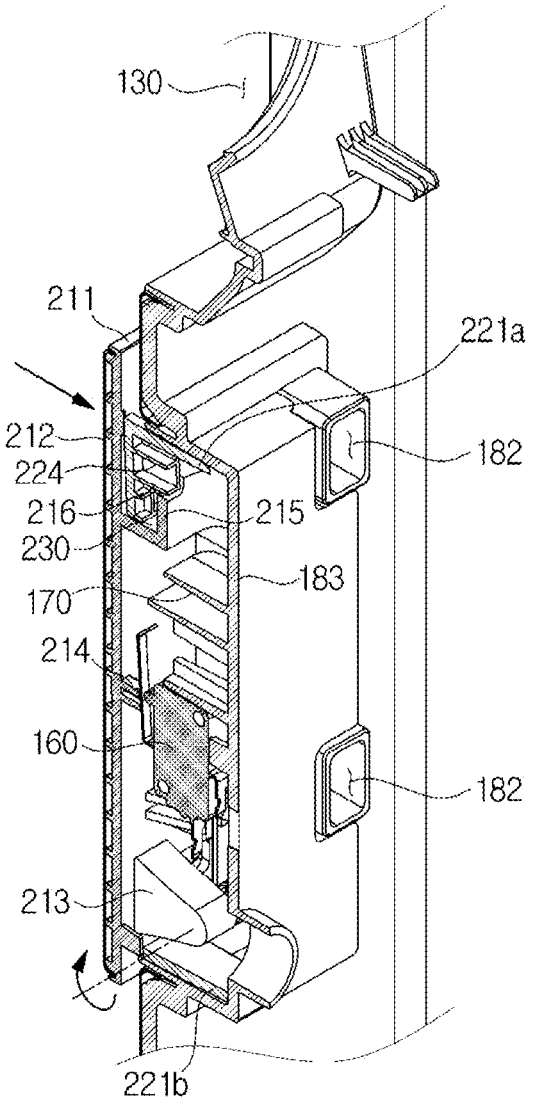
FIG. 10 is a cross-sectional perspective view illustrating a state in which the dispenser of the refrigerator according to one embodiment of the present disclosure is pressurized.

FIG. 4 is an exploded perspective view illustrating a portion of a configuration of the dispenser 100 of the refrigerator 1 according to one embodiment of the present disclosure, FIG. 5 is a perspective view illustrating a rear side of the lever unit 200 of the refrigerator 1 according to one embodiment of the present disclosure, FIG. 6 is a perspective view illustrating rear sides of a lever 210 and a guide 230 of the refrigerator 1 according to one embodiment of the present disclosure, FIG. 7 is a perspective view of a frame 220 of the refrigerator 1 according to one embodiment of the present disclosure, FIG. 8 is a front view of an insertion portion 180 of the refrigerator 1 according to one embodiment of the present disclosure, FIG. 9 is a cross-sectional perspective view of the dispenser 100 of the refrigerator 1 according to one embodiment of the present disclosure, FIG. 10 is a cross-sectional perspective view illustrating a state in which the dispenser 100 of the refrigerator 1 according to one embodiment of the present disclosure is pressurized, and FIG. 11 is an enlarged view of a guide protrusion 224 and a cover 216 according to one embodiment of the present disclosure.

As shown in FIG. 4, the dispenser 100 may be disposed on a front surface side of the door 11*a*. The dispenser 100 may include the outlet 130 through which a beverage or ice is withdrawn, a placing space 140 in which a user can place a vessel, and a display 150 through which the user can select a beverage or ice and configured to display various information.

An insertion portion 180, into which the lever unit 200 is inserted and at which a switch 160 is disposed, may be provided on an inner side wall of the placing space 140.

When the user pressurizes the lever unit 200, the switch 160 may be pressurized by the lever unit 200 to transmit an electrical signal to a controller (not shown) of the refrigerator 1.

As shown in FIGS. 5 to 7, the lever unit 200 may include a lever 210, and a frame 220 which supports the lever 210 to be tiltable.

The lever 210 may include a body 211 constituting an appearance of the lever 210, and a front surface portion 212 disposed at a front surface of the body 211. The front surface portion 212 may be formed of a material corresponding to a front portion of the door 11 or a material corresponding to the placing space 140 in order to improve an aesthetically pleasing feeling of the dispenser 100, whereas the front surface portion 212 may be formed of a material that is completely different from those of the front portion and the placing space 140. However, the present disclosure is not limited to the above-described embodiment, and the lever 210 may not include the front surface portion 212, and the body 211 may form a front surface of the lever 210.

A tilt coupler 213 extending toward a rear side and tiltably coupled to the frame 220 may be provided at a rear surface 211*a* of the body 211. The tilt coupler 213 may be provided at a lower side portion of the lever 210, and the lever 210 may be tilted relative to the frame 220 relative to the tilt coupler 213 as a rotational axis thereof.

A pressurizer 214 extending toward a rear side and configured to pressurize and operate the switch 160 when the user pressurizes the front surface portion 212 may be disposed on the rear surface 211*a* of the body 211.

When the user pressurizes the front surface portion 212, the lever 210 may be tilted in a direction toward the rear side relative to the tilt coupler 213 as a rotational axis thereof, and the pressurizer 214 may be moved toward the rear side of the lever 210 by being interlocked with the tilting of the lever 210 to pressurize the switch 160 disposed behind the lever 210.

The frame 220 may be disposed behind the lever 210 and coupled to the tilt coupler 213 to support the lever 210. The frame 220 may include an upper surface 221*a*, a bottom surface 221*b*, and a pair of side surfaces 221*c* and 221*d* connecting both ends of the upper surface 221*a* and the bottom surface 221*b*.

An open portion 222 open in a front side direction and a rear side direction may be provided between the upper surface 221*a*, the bottom surface 221*b*, and the pair of side surfaces 221*c* and 221*d*. The pressurizer 214 may pressurize the switch 160 disposed behind the lever 210 through the open portion 222.

A pair of tilt coupling recesses 223 to which the tilt couplers 213 are rotatably coupled may be provided on inner side surfaces of the pair of side surfaces 221*c* and 221*d*. A coupling protrusion of the tilt coupler 213 is inserted into the tilt coupling recess 223 so that the lever 210 may be tilted relative to the frame 220.

The lever unit 200 may include an elastic member 240 disposed between the tilt coupling recess 223 and the tilt coupler 213. The elastic member 240 may be provided to elastically pressurize the lever 210 toward the front side.

That is, one side of the lever 210 may be tiltably coupled to the frame 220 by the tilt coupler 213, and may receive a force pressing toward the front side by the elastic member 240. A stopper 215 may be disposed at the other side of the lever 210 to maintain an engaged state of the lever 210 by being brought into contact with a portion extending from the upper surface 221*a* of the frame 220 toward the rear side to prevent the lever 210 from escaping toward the front side due to the elastic member 240.

The lever unit 200 may include a guide 230 extending from the rear surface 211*a* of the body 211 and guiding condensation generated in the outlet 130 to be bypassed from the switch 160 to prevent the condensation from flowing into the switch 160.

The guide 230 may include a first surface 231*a* configured to cover an upper side of the switch 160, a pair of second surfaces 231*b* configured to cover both sides of the switch 160, and a connecting surface 231*c* configured to connect both ends of the first surface 231*a* to the pair of second surfaces 231*b*.

The guide surfaces 231*a*, 231*b*, and 231*c* extend from the rear surface 211*a* of the body 211 toward the rear side and cover the upper side and both of the sides of the switch 160 to prevent condensation dropping from the outlet 130 from flowing into the switch 160.

The guide 230 may include a bent portion 232 configured to bent at and extend from one end of each of the guide surfaces 231*a*, 231*b*, and 231*c*. The bent portion 232 may be bent in an outer direction of the switch 160.

When condensation is present on the guide surfaces 231*a*, 231*b*, and 231*c*, the condensation may flow from an upper side to a lower side along the guide surfaces 231*a*, 231*b*, and 231*c* by the bent portion 232 and bypass the switch 160 without flowing toward the rear side.

The guide 230 may extend from the rear surface 211*a* of the body 211 to be integrally formed with the lever 210, but the present disclosure is not limited thereto, and the guide 230 may be provided as a separate member and disposed at the rear side of the lever 210.

The guide 230 may be provided such that at least a portion of the guide 230 is disposed inside the open portion 222 of the frame 220. More specifically, at least a portion of the guide surfaces 231*a*, 231*b*, and 231*c* may be disposed inside the open portion 222 and pass therethrough. Further, the bent portion 232 may be provided and disposed at a rear side of the open portion 222. The guide 230 will be described in detail below.

The frame 220 may be provided and inserted into the insertion portion 180 recessed into the front surface of the door 11*a* such that the lever unit 200 is disposed at the front surface of the door 11*a* (See, FIG. 4).

Since a lever of a conventional dispenser is provided in a structure in which a tilt coupler of the lever is coupled to one side of a door, the lever cannot be stably supported due to an external force. That is, since the user pressurizes the lever such that the lever receives an external force not only in forward and backward directions but also in vertical and horizontal directions, there is a problem in durability of the dispenser, such as the lever escaping from the door and the like.

However, the lever unit 200 of the dispenser 100 according to the embodiment of the present disclosure is configured such that the frame 220 supporting the lever 210 is entirely inserted into the door 11*a* instead of simply coupling the lever 210 to one side of the door 11*a*, and thus the lever 210 can be stably supported.

More specifically, when the frame 220 is inserted into the insertion portion 180, the upper surface 221*a*, the bottom surface 221*b*, and the pair of side surfaces 221*c* and 221*d* of the frame 220 are provided to be brought into contact with four surfaces 181 provided at the insertion portion 180, and thus the lever unit 200 is stably supported on the door 11*a* such that reliability of the refrigerator 1 can be enhanced.

As shown in FIG. 8, the insertion portion 180 may be provided to have a dimension corresponding to that of the frame 220, and may include the four surfaces 181 corresponding to the upper surface 221*a*, the bottom surface 221*b*, and the pair of side surfaces 221*c* and 221*d* of the frame 220, respectively.

When the frame 220 is inserted into the insertion portion 180, even though an external force is generated at the lever 210 in vertical and horizontal directions by the frame 220 being inserted into the insertion portion 180 in a state in which the four surfaces 181 are brought into contact with the upper surface 221*a*, the bottom surface 221*b*, and the pair of side surfaces 221*c* and 221*d*, respectively, the upper surface 221*a*, the bottom surface 221*b*, and the pair of side surfaces 221*c* and 221*d* of the frame 220 are supported on the four surfaces 181, respectively, such that the lever unit 200 can be stably supported on the door 11*a*.

Further, the frame 220 may include a hook portion 225 connected from a rear side of each of the pair of side surfaces 221*c* and 221*d* of the frame 220 to the rear side thereof (See, FIG. 5), and the hook recess 182 is provided at a position of the insertion portion 180 corresponding to the hook portion 225.

When the frame 220 is inserted into the insertion portion 180, the hook portion 225 is hook-coupled to the hook recess 182 such that the lever unit 200 can be stably supported on the insertion portion 180. Further, the frame 220 is simply pressurized toward the door 11*a* and hook-coupled to the insertion portion 180 such that assembly can be enhanced.

Two pairs of hook portions 225, that is, four hook portions 225, may be provided, and one of the two pairs may correspond to the pair of side surfaces 221*c* and 221*d*, and four hook recesses 182 may be provided to correspond to the two pairs of hook portions 225.

However, the present disclosure is not limited to the described above, and the hook portion 225 may extend from the upper surface 221*a* or the bottom surface 221*b*, and four or less hook portions 225 may be configured.

The frame 220 may include a contact protrusion 226 protruding from a rear end 226*a* of the frame 220 toward the rear side and configured to come into contact with an inner surface 183 of the insertion portion 180. The contact protrusion 226 may be provided to come into contact with the inner surface 183 of the insertion portion 180 when the frame 220 is inserted into the insertion portion 180, and, when the lever unit 200 receives an external force in the forward and backward directions, the contact protrusion 226 may stably support the lever unit 200 while in contact with the inner surface 183.

That is, the contact protrusion 226 may be made of a material having elasticity as a buffer member against an external force in the forward and backward directions. However, the present disclosure is not limited to the described above, and the contact protrusion 226 may be made of a material having no elasticity, and the frame 220 may be provided such that the rear end 226*a* is in direct contact with the inner surface 183 without the contact protrusion 226.

The insertion portion 180 may be provided to include a switch supporter 184 configured to support the switch 160 such that the switch 160 may be disposed in the insertion portion 180.

An auxiliary guide 170 may be provided at the insertion portion 180 to cover the upper side and the both sides of the switch 160.

The auxiliary guide 170 may be disposed between the guide 230 and the switch 160 to doubly protect the switch 160 from condensation in association with the guide 230. That is, in order to prevent condensation flowing inside the insertion portion 180, which is not guided by the guide 230, from flowing into the switch 160 side, the auxiliary guide 170 may cover the upper side and the both sides of the switch 160 and guide the condensation flowing into the switch 160 side to be bypassed and flow to the outside.

As shown in FIGS. 9 and 10, in a state in which the lever unit 200 is inserted and assembled into the insertion portion 180, a lower side portion of the lever 210 may be coupled to the frame 220 by the tilt coupler 213, and, as described above, the lever 210 may be provided to be pressurized toward the front side by the elastic member 240 disposed at the tilt coupler 213 side (See, FIG. 5).

The lever 210 may be prevented from escaping by the stopper 215 disposed at an upper side portion of the lever 210 even when the lever 210 is pressurized toward the front side by the elastic member 240. The stopper 215 may be disposed to be in contact with a rear side surface of the frame 220 to support an upper side of the lever 210, thereby preventing the lever 210 from escaping toward the front side.

The stopper 215 is provided at an upper side of the bent portion 232 (See, FIG. 6) to come into contact with a rear surface of an upper side of the frame 220. That is, the lever 210 may be coupled to one side of the frame 220 by the tilt coupler 213 disposed at one side of the lever 210, and may be supported on the other side of the frame 220 by the stopper 215 disposed at the other side of the lever 210.

When the lever 210 is not pressurized, the lever 210 may be disposed at a predetermined position due to the stopper 215. At this point, the pressurizer 214 may be disposed and spaced apart from the switch 160 to maintain a state in which the switch 160 is not pressurized.

When a user pressurizes the front surface portion 212, the lever 210 may be rotated toward the rear side relative to the tilt coupler 213 as a rotational axis thereof. At this point, the stopper 215 may be moved toward the rear side of the lever 210 by being interlocked therewith to be disposed and spaced apart from the rear surface of the frame 220, and the pressurizer 214 may also be moved toward the rear side of the lever 210 by being interlocked therewith to pressurize the switch 160.

The switch 160 may be operated by the pressurizer 214 to transmit an electrical signal to a controller (not shown) such that a beverage or ice may be withdrawn through the outlet 130.

Then, when the user stops pressurizing the lever 210, the lever 210 may be rotated again toward the front side by the elastic member 240 relative to the tilt coupler 213 as the rotational axis thereof. Rotation of the lever 210 pressurized toward the front side may be restricted when the stopper 215 is in contact with the rear surface of the frame 220, and then the lever 210 may again be disposed at the predetermined position.

Figure 11A:
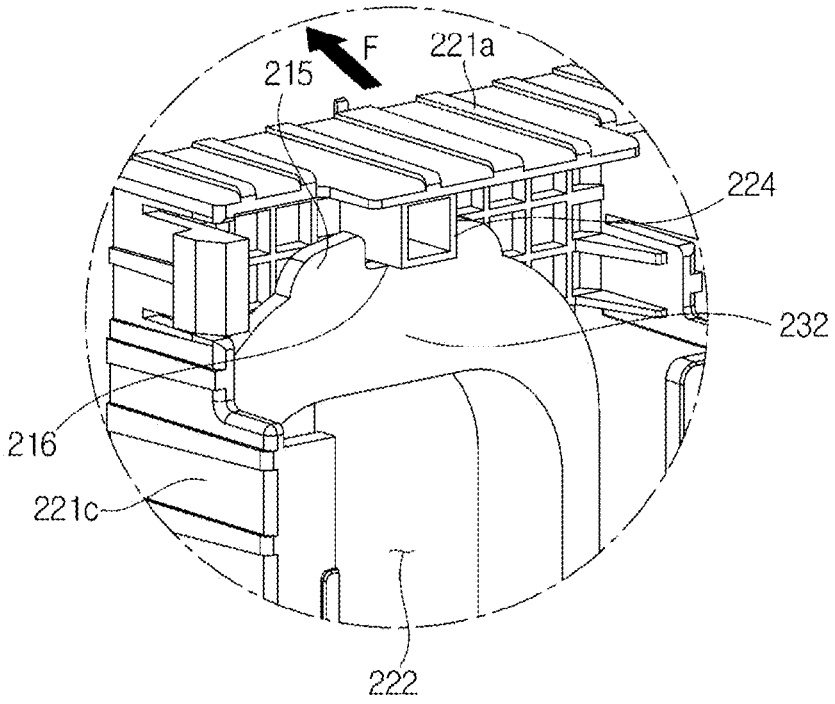
FIG. 11A & FIG. 11B is an enlarged view of a guide protrusion and a cover according to one embodiment of the present disclosure.
Figure 11B:
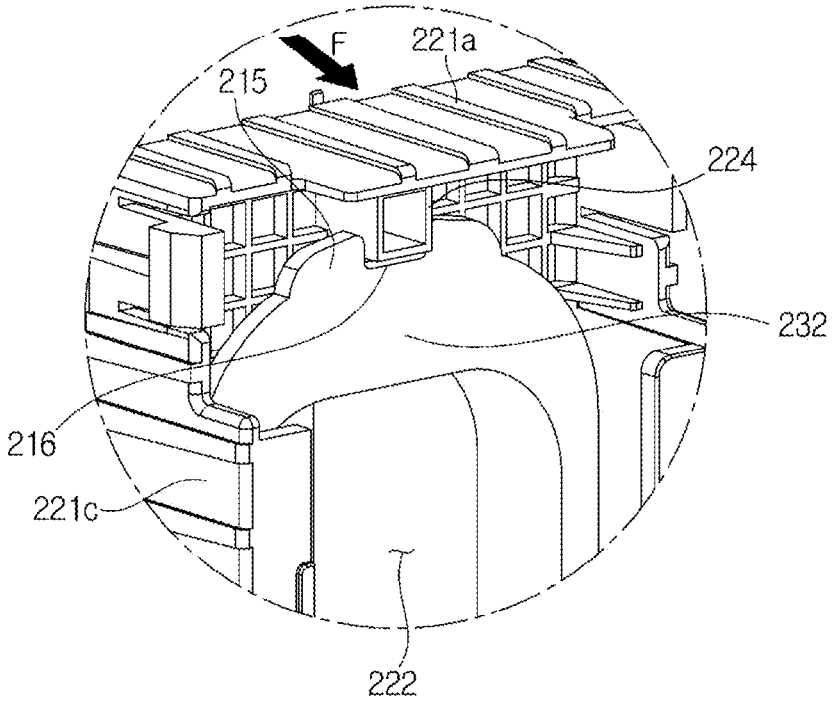

As shown in FIGS. 11A and 11B, the frame 220 may include a guide protrusion 224 configured to guide the lever 210 when the lever 210 is tilted.

Further, the lever 210 may include a cover 216 configured to cover the guide protrusion 224 in order to guide the tilting of the lever 210 with the guide protrusion 224.

The cover 216 covers at least a part of a lower side portion and both side portions of the guide protrusion 224 such that, even when an external force is applied thereto in left and right directions while the lever 210 is tilted, the lever 210 can be stably tilted in the forward and backward directions.

The guide 230 will be described in detail below.

Figure 12:
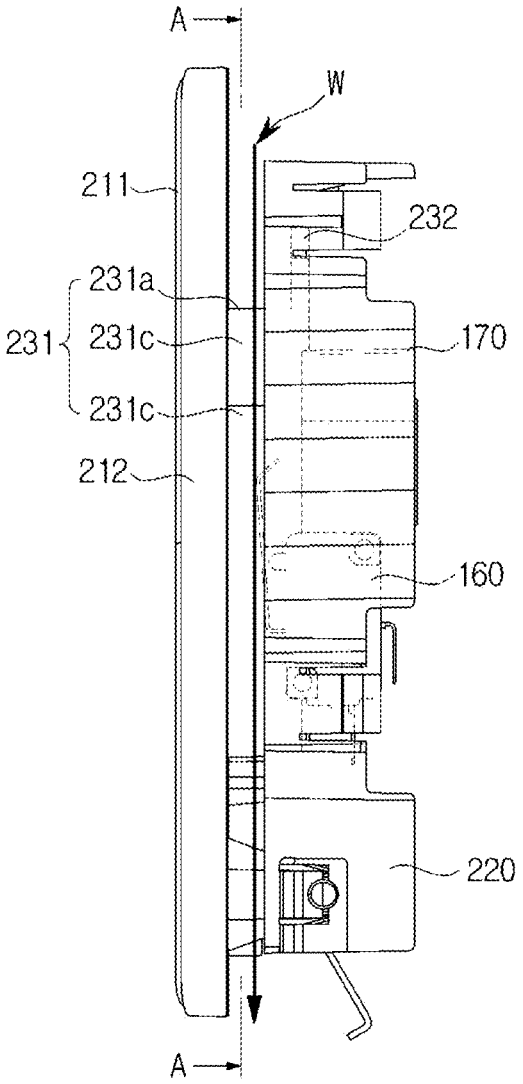
FIG. 12 is a side view of the lever unit according to one embodiment of the present disclosure.
Figure 13:
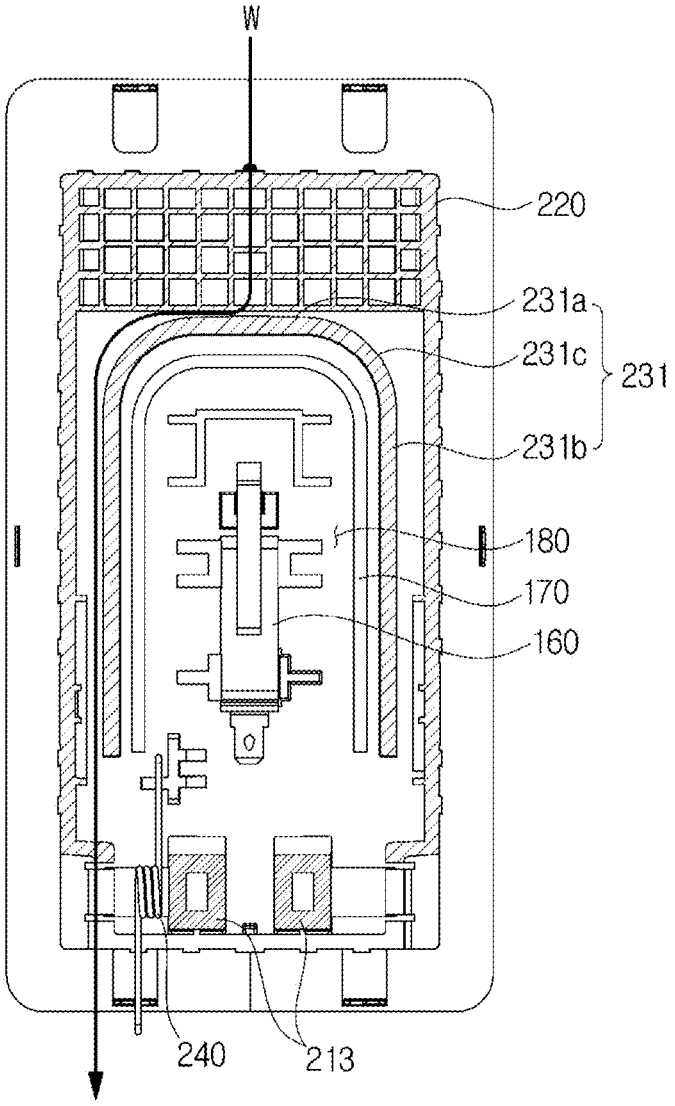
FIG. 13 is a cross-sectional view taken along line A-A in FIG. 12.

FIG. 12 is a side view of the lever unit 200 according to one embodiment of the present disclosure, and FIG. 13 is a cross-sectional view taken along line A-A in FIG. 12.

As shown in FIG. 12, at least a portion of the guide surfaces 231*a*, 231*b*, and 231*c* of the guide 230 may be disposed between the lever 210 and the frame 220. Further, the first surface 231*a* may be disposed above the switch 160 and may be provided to extend in left and right directions in a state in which the lever unit 200 is assembled, and the second surface 231*b* may be disposed at both side surfaces of the switch 160 and may be provided to extend vertically such that, when condensation flows into the lever unit 200, the guide 230 may guide the condensation in a lower side direction of the lever 210 between the rear surface of the lever 210 and the front surface of the frame 220.

As described above, at least a portion of the guide 230 may be disposed to pass through the open portion 222, and the guide 230 may be disposed to correspond to the open portion 222 in a vertical direction of the lever 210.

Consequently, when the lever 210 is tilted, the guide 230 may be moved inside the open portion 222 by being interlocked with the lever 210 such that the tilting of the lever 210 cannot be restricted.

Even when the lever 210 is tilted or maintained at a predetermined position, a portion of the guide 230 may be provided and disposed between the rear surface of the lever 210 and the front surface of the frame 220 to guide condensation between the lever 210 and the frame 220.

Condensation may move along the guide surface 231 between the lever 210 and the frame 220, but some of the condensation may flow inside the frame 220. However, the bent portion 232 may be disposed at one end of the guide surface 231 to prevent the condensation flowing inside the frame 220 from flowing into the switch 160.

As shown in FIG. 13, the guide 230 may be disposed to cover the upper side and the both sides of the switch 160 to prevent condensation from flowing thereto from the outside of the upper and side portions of the switch 160.

Accordingly, the condensation flowing from the upper side of the switch 160 may move along the first surface 231*a* in left and right directions of the lever 210, and then may flow along the connecting surface 231*c* and the second surface 231*b* to flow toward the lower side of the lever unit 200. That is, the guide 230 may guide the condensation to bypass the switch 160, thereby preventing the condensation from flowing into the switch 160.

The condensation may be primarily prevented from flowing into the switch 160 by the guide 230, and may be secondarily prevented from flowing into the switch 160 by the auxiliary guide 170 disposed between the guide 230 and the switch 160.

Consequently, even though some of the condensation flows into an inner side space between the guide 230 and the insertion portion 180, the condensation can be prevented from flowing into the switch 160 by the guide 170.

The condensation may mainly flow from the outlet 130, but the present disclosure is not limited thereto, and the condensation may flow into the lever unit 200 through various flow paths and may be guided to the outside of the lever unit 200 by the guide 230.

In accordance with the embodiments of the present disclosure, a coupling ability between the lever unit of the dispenser and the door can be enhanced.

Further, in accordance with the embodiments of the present disclosure, the guide can effectively protect the switch of the dispenser from an inflow of condensation.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body having a storage compartment;

a door configured to open and close the storage compartment; and a dispenser including a switch and a lever unit configured to pressurize the switch, wherein the lever unit includes:

a lever including a body and a pressurizer extending toward a rear side of the body and configured to pressurize the switch;

a frame disposed behind the body and configured to support the lever; and a guide extending from a rear surface of the body, the guide including a first surface extending in a horizontal direction and a second surface extending in a vertical direction and a connecting surface bent to connect the first surface and the second surface, the guide configured to:

cover the switch to prevent condensation from flowing into the switch, and guide the condensation between the lever and the frame.

2. The refrigerator of claim 1, wherein:

the frame includes an open portion that is open in front and rear directions of the lever, and at least a portion of the guide is provided to pass through the open portion of the frame.

3. The refrigerator of claim 2, wherein the connecting surface is disposed at a rear side of the open portion of the frame.

4. The refrigerator of claim 3, wherein:

the guide is configured to guide condensation, which flows from an outlet, in a vertical direction of the lever.

5. The refrigerator of claim 3, wherein:

the frame further includes a guide protrusion extending from a rear surface of the frame toward the rear side to guide movement of the lever when the lever is tilted, and the lever further includes a cover provided at one side of the bent portion to cover the guide protrusion and allow the lever to be guided by the guide protrusion when the lever is tilted.

6. The refrigerator of claim 4, wherein:

the first surface extends in left and right directions of the lever, the second surface includes a pair of second surfaces extending in the vertical direction of the lever, and the connecting surface is configured to connect both ends of the first surface to upper ends of the pair of second surfaces, respectively.

7. The refrigerator of claim 6, wherein the first surface is disposed above the switch, and the pair of second surfaces are disposed at both sides of the switch, respectively.

8. The refrigerator of claim 7, wherein the dispenser further includes an auxiliary guide disposed between the first surface and the switch to further prevent the condensation from flowing into the switch.

9. The refrigerator of claim 8, wherein the auxiliary guide is configured to cover an upper surface of the switch and side surfaces of the switch.

10. The refrigerator of claim 1, wherein:

the lever further includes a tilt coupler extending toward a rear side of the lever and coupled to one side of the frame to tiltably couple the lever to the frame, and the frame further includes a tilt coupling recess disposed at the one side of the frame and provided to allow the tilt coupler to be rotatably inserted into the tilt coupling recess.

11. The refrigerator of claim 10, wherein:

the lever unit further includes an elastic member disposed between the tilt coupler and the tilt coupling recess and configured to elastically support the lever, and the lever further includes a stopper configured to be brought into contact with the other side of the frame to restrict an elastic movement of the lever.

12. The refrigerator of claim 1, wherein the frame includes:

an upper surface, a bottom surface, and a pair of side surfaces provided between both ends of the upper surface and the bottom surface.

13. The refrigerator of claim 12, wherein:

the dispenser further includes an insertion portion disposed at one side of the door to allow the lever unit to be inserted into the one side of the door, and the insertion portion is provided to be brought into contact with the upper surface, the bottom surface, and the pair of side surfaces of the frame.

14. The refrigerator of claim 13, wherein:

the frame further includes a hook portion extending toward a rear side of the frame and hook-coupled to the insertion portion, and the insertion portion includes a hook recess hook-coupled to the hook portion.

15. The refrigerator of claim 13, wherein the frame further includes a contact protrusion extending from at least one among the upper surface, the bottom surface, and the pair of side surfaces of the frame and disposed to be brought into contact with the insertion portion.

16. A refrigerator comprising:

a main body having a storage compartment;

a door configured to open and close the storage compartment;

an insertion portion provided at one side of the door;

a switch disposed at the insertion portion; and a lever unit inserted into the insertion portion and configured to pressurize the switch, wherein the lever unit includes:

a lever including a body and a tilt coupler disposed at a rear side of the body and provided to allow the body to be tiltable;

a frame coupled to the tilt coupler and inserted into the insertion portion; and a guide extending from a rear surface of the body, the guide including a first surface extending in a horizontal direction and a second surface extending in a vertical direction and a connecting surface bent to connect the first surface and the second surface, the guide configured to:

cover an upper side and a side surface of the switch, and guide condensation between the lever and the frame to prevent the condensation from flowing into the switch.

17. The refrigerator of claim 16, wherein:

the frame includes an open portion that is open in front and rear directions of the lever, and the guide is provided at a position corresponding to the open portion in a vertical direction of the lever.

18. The refrigerator of claim 16, wherein the insertion portion includes an auxiliary guide disposed between the guide and the switch to further prevent the condensation from flowing into the switch.

19. The refrigerator of claim 18, wherein the auxiliary guide is provided to cover the upper side and the side surface of the switch.

20. A refrigerator comprising:

a main body having a storage compartment;

a door configured to open and close the storage compartment;

an insertion portion having four surfaces formed to be recessed from one side of the door toward an interior of the door;

a switch disposed on the insertion portion at the one side of the door; and a lever unit inserted into the insertion portion and configured to pressurize the switch, wherein the lever unit includes:

a frame having four surfaces configured to be brought into contact with the four surfaces of the insertion portion, respectively, and inserted into the insertion portion;

a lever coupled to the frame; and a guide extending from a rear surface of the body, the guide including a first surface extending in a horizontal direction and a second surface extending in a vertical direction and a connecting surface bent to connect the first surface and the second surface, the guide configured to cover the switch to prevent condensation from flowing into the switch.

* * * * *